US006032609A

United States Patent [19]

Luoma

[11] Patent Number: 6,032,609

[45] Date of Patent: Mar. 7, 2000

[54] DOSAGE INDICATOR MEDICINE CONTAINER

[76] Inventor: Van A. Luoma, 329 Edith Dr., West St. Paul, Minn. 55118

[21] Appl. No.: 08/966,885

[22] Filed: Nov. 10, 1997

[51] Int. Cl.[7] ..... G09F 9/00

[52] U.S. Cl. ..... 116/306; 116/205; 206/459.1; 215/230

[58] Field of Search ..... 116/306, 307, 116/308, 334, 335, 200, 201, 203, 205, 212, 280, 206, 327, 279, DIG. 1, DIG. 17, DIG. 28; 206/459.1; 215/230, 365

[56] References Cited

U.S. PATENT DOCUMENTS

| | | | |
|---|---|---|---|
| 332,208 | 12/1885 | Noel . | |
| 648,063 | 4/1900 | Bauman | 116/308 |
| 2,695,000 | 11/1954 | Farkas et al. . | |
| 2,833,064 | 5/1958 | Parker | 116/306 |
| 3,227,127 | 1/1966 | Gayle . | |
| 3,757,441 | 9/1973 | Baustin | 116/308 |
| 3,921,568 | 11/1975 | Fish | 116/308 |
| 3,974,916 | 8/1976 | Bartolucci | 116/307 |
| 3,996,879 | 12/1976 | Walton . | |
| 4,528,933 | 7/1985 | Allen . | |
| 4,752,087 | 6/1988 | Weisbach | 206/459.1 |
| 4,753,189 | 6/1988 | Mastman et al. . | |
| 4,756,423 | 7/1988 | Holtsch . | |
| 4,802,438 | 2/1989 | DeJonge . | |
| 4,830,407 | 5/1989 | Sadler, Jr. et al. | 116/308 |
| 4,913,083 | 4/1990 | Valvo et al. . | |
| 4,986,429 | 1/1991 | Singleton, Jr. | 206/459.1 |
| 5,009,338 | 4/1991 | Barker . | |
| 5,216,975 | 6/1993 | Bartholomew . | |
| 5,279,422 | 1/1994 | Adams . | |
| 5,358,117 | 10/1994 | Adams . | |
| 5,386,795 | 2/1995 | Bartholomew . | |
| 5,421,286 | 6/1995 | McLean | 116/200 |
| 5,694,882 | 12/1997 | Marshall | 206/459.1 |

*Primary Examiner*—Andrew Hirshfeld
*Attorney, Agent, or Firm*—Nikolai, Mersereau & Dietz, P.A.

[57] ABSTRACT

The combination of a bottle used to contain pharmaceutical products such as capsules, pills, tablets, caplets, gelcaps or the like and a permanent indicia system having a plurality of indicators operated sequentially by an irreversible physical act producing a permanent dosage recording indicator, the exposure of a plurality of said indicators showing a cumulative dosage record.

4 Claims, 4 Drawing Sheets

DOSAGE INDICATOR MEDICINE CONTAINER

BACKGROUND OF THE INVENTION

I. Field of the Invention

The present invention relates generally to medicine containers and, more particularly, to devices associated with medicine containers which have a time-variable indicator that presents a dosage compliance record. Specifically, the present invention relates to a simple, low cost compliance record indicator for use with medicine container caps or the containers themselves which promotes timely taking of the medications and which, at the same time, displays a permanent compliance record which cannot be inadvertently altered.

II. Related Art

Medicines including pills, capsules, tablets, gelcaps, geltabs, caplets and the like have traditionally been packaged in bottles or other such containers capped with a variety of closure devices. The caps or closures for these containers have taken a variety of forms and, more recently, have included a key system, depress-and- turn system, or the like, designed to prevent small children from gaining access to the contents.

Most prescription medications, for example, antibiotics, need to be taken at particular predetermined spaced time intervals until depleted. Of course, as is the case with many antibiotics, if the course of treatment is not correctly followed, the full efficacy of the antibiotic may not be realized and the infection may not be cured. Other medications may need to be taken once a day or several times a day, or possibly even less than once a day, but over long periods of time.

One problem associated with maintaining a prescribed regimen of medication is associated with determining status of compliance at any time. Many persons, especially elderly persons, have difficulty in maintaining consistent compliance, particularly when a plurality of medications must be administered, possibly each adhering to a different timetable. While not remembering whether (or which) medicine has been taken is a problem particularly associated with the elderly, it clearly is not limited to that group and may easily lead to under or over dosing by anyone taking medication.

There are many prior art attempts to address problems of this nature which generally incorporate some type of a time, date or dosage indicating device on the cap or other part of the container which involves a moveable pointer or other such device designed to be indicative of the status of medicine administration. These devices generally involve the relative motion of a pointer, plate or other indicator relative to a dial, possibly an indicator which is moved each time the medicine is used to indicate the fact that the medicine has been taken and/or the time when the next dosage is due.

Systems including a pointer and dial indicator on the container cap are illustrated in U.S. Pat. Nos. 5,358,117 and 5,279,422 to Adams. Other indicating systems contained in the medicine container cap include relatively moveable devices for selecting indicia indicating use such as that found in U.S. Pat. Nos. 5,216,975 and 5,386,795 to Bartholomew. A further reminder device having relatively moveable elements is depicted in U.S. Pat. No. 3,996,879 to Walton. While these approaches are viable as long as they are properly used, the indicating position is easily altered and presents no reliable permanent record.

Various other devices include mechanical advancing systems that coordinate with the operation of the bottle cap. Such devices are illustrated by Mastman et al. in U.S. Pat. No. 4,753,189; Alan in U.S. Pat. No. 4,528,933; and Barker in U.S. Pat. No. 5,009,388. These devices are somewhat more reliable than those where the relative motion of the parts is easily and inadvertently reversible, however, these indication systems are generally more complicated in construction and more expensive to implement than others making them undesirable from the standpoint of cost for the pharmaceutical industry.

It will be appreciated from the above that a great variety of approaches have been suggested with respect to compliance indicator systems associated with medicine dispensing containers. None has provided the necessary reliability and inexpensive implementation necessary for today's plastic throw-away medicine containers. Hence, while "child proof" construction has been mandated, to date there has been no commercially successful dosage indicator added to disposable medicine containers. Accordingly, there remains a need for the implementation of an inexpensive and reliable method for tracking the status of on-going treatment compliance with regard to conventional medicine containers.

It is therefore a primary object of the present invention to provide an inexpensive and reliable dosage tracking system for use with a throw-away medicine vial or bottle.

Another object of the invention is to provide an inexpensive and reliable dosage tracking or compliance system adaptable to a medicine bottle or vial which can readily be used by even elderly and infirm patients.

A further object of the invention is to provide an inexpensive and reliable dosage counter for a disposable medicine bottle or vial which provides a permanent record of registered events of medication consumed.

A still further object of the invention is to provide an inexpensive and reliable dosage counter for a disposable medicine bottle or vial in which dosage recording is easily implemented utilizing a fingernail of the patient, or the like.

Other objects and advantages of the invention will occur to those skilled in the art upon becoming familiar with the specification, drawings and claims contained in this application.

SUMMARY OF THE INVENTION

By means of the present invention there is provided an inexpensive and accurate indication system regarding the status of administration of medicine from a multiple-dose container which provides a permanent record of use. The system can be used with present containers and requires no moving parts. The system is generally characterized by a series of user initiated indication marks symbolic of each dosage taken. Indication may be in the form of indentation marks, which may, for example, be made by breaking seals deforming pliable material, removing an overlayer or impressing a pressure sensitive indicator. The forms of the system are designed to be operable by a fingernail, for example, and provide or record a permanent change in a disk or strip. Use may be indicated by the appearance of a different color as part of a single layer or multi-layer planak system or beneath a seal covering a corresponding mark or notch. Any kind of surface or cover layer that can be broken, indented, breached, removed or pressed upon to expose or produce an indicator can be utilized. Multiple disks or strips can be provided for additional or longer dosage intervals corresponding to the amount of medication in the container. Of course, any type of instrument, such as a butter knife, for example, can also be used to apply pressure, make an indentation, break a seal covering a notch or mark or remove a scratch-off layer at the time the dosage is taken.

In one embodiment, the system is implemented utilizing a disk, strip or band of readily deformable material, such as a polymer foam, for example, in which a fingernail indentation or the like, creates a recess and exposes a contrasting color at each in a series of dosage indication locations. Another embodiment uses a notch and seal system in which a disk, strip or band attached around the bottle or to the cap is provided with a series of marks or notches or other recesses with perforated or otherwise easily removed knock-out covers or seals corresponding to the dosage times or intervals which can readily be opened by a fingernail, or the like, to indicate that the dosage has been taken.

In yet another embodiment, a contrasting color may appear in response to pressing on a pressure sensitive area or zone without necessarily indenting the material. Another embodiment uses a scratch-off type over-layer covering or removing an indication of contrasting color.

It will be noted that the marking system of the invention provides a permanent record that the event of consciously and actively creating a mark has taken place eliminating the danger of mispositioning a pointer or other moveable device and later repeating or missing a dose. In addition, no moving parts are required in the system and the indicator disks or other implementing devices, such as strips, can readily be added to the tops (caps) or sides or bottoms of conventional throw-away pill bottles or vials. The strips or disks can also be stacked one on another, for example, for multiple weeks of dosage indication with an entire disk or strip being removed to expose a new one after all dosages have been counted on that disk or strip.

As indicated, the system of the invention readily adapts itself to embodiments that include the use of pressure sensitive indicators, scratch-off indicators or those operation by removal of release paper, pull-off tabs or the like. However, the preferred embodiment involves easily indented or deformed material or the use of grooves, notches or indentable surfaces inasmuch as the indented marking of a surface or breaking of seals or perforated knock-outs above grooves or notches is less apt to occur inadvertently. In the easily indented version, a multi-colored foam material can be used which, when indented, pressed down or broken, reveals a different under color. All embodiments have the common properties that they are easily used, provide a permanent record that an active function has been performed to mark the vessel and none require moving parts. All may be designed to be adhesively applied to existing medicine vials.

BRIEF DESCRIPTION OF THE DRAWINGS

In the drawings, wherein like numerals are utilized to designate like parts throughout the same.

DETAILED DESCRIPTION

The present invention presents a simple, easily used nd accurate system for maintaining a compliance record indicative of the administration of a medication from a typical throw-away pill bottle or vial that establishes and maintains a permanent and accurate record. The system of the invention is easily used by even the elderly and infirm and requires no moving parts which add complication and expense to the device. It will be recognized that the invention encompasses a concept which may take any of several forms, all of which retain the desirable attributes. Thus, whereas the descriptions of the illustrated embodiments contained in this specification are directed primarily to indentation-type systems using color change, it will be recognized that other such implementations as press-down color change, scratch-off indicators or those using peel-off devices such as types of release papers are also contemplated and would readily adapt. The main attributes being that it is accurate, low cost and easy to fit to a container and to use by the patient.

Keeping these things in mind, consideration will next be made of the several views of the figures illustrating one or more exemplary embodiments of the invention.

Figure 1:
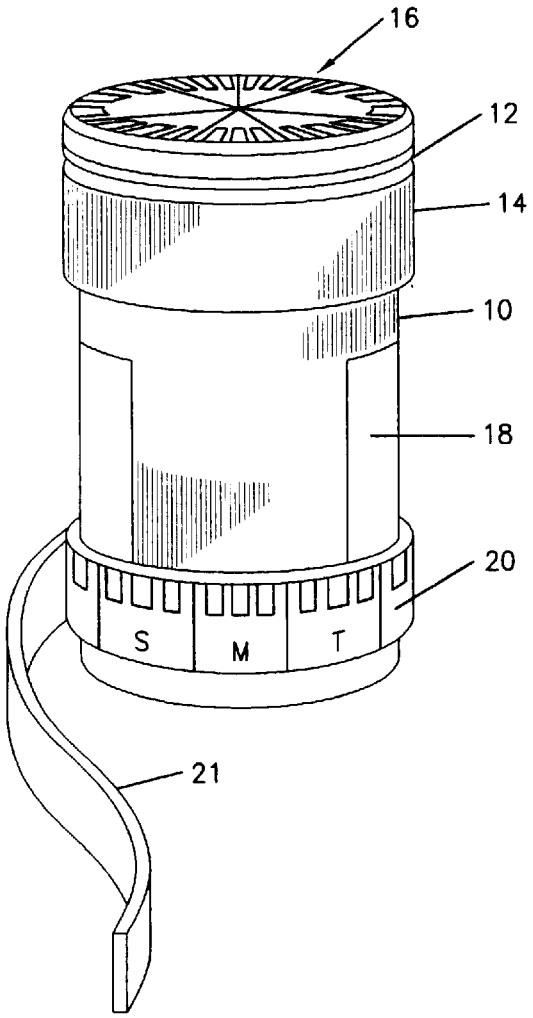
FIG. 1 is a perspective view representing a typical plastic throw-away medicine or pill container fitted with examples of the dosage indicating system of the invention.

FIG. 1 depicts a pill container which may be a bottle or vial generally at 10 and having a screw or pop-off cap 12, both of which may be quite conventional such as the familiar darkened and plastic pill vials generally used in prescription commerce. The cap 12 has a knurled or gripping edge 14 and is shown fitted with an indicator disk 16 in accordance with the invention. A label is shown at 18 and an alternate indicator embodiment is shown disposed about the lower portion of the vial 10 at 20 with a possible second or over layer shown at 21.

Figure 2:
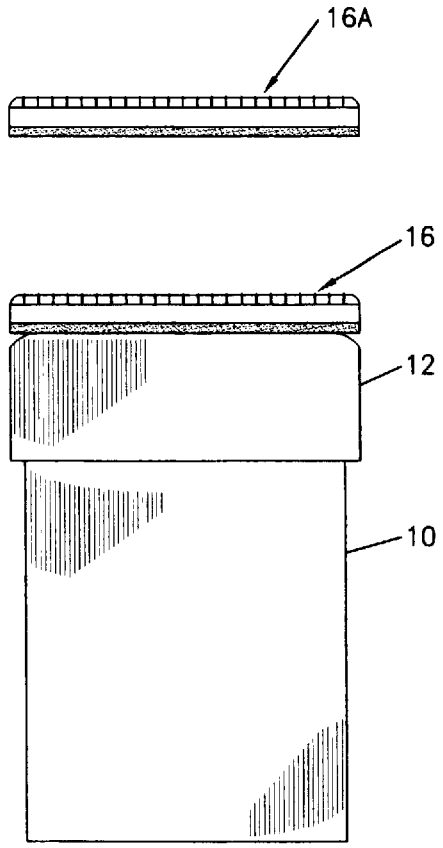
FIG. 2 is a side elevational view, partly exploded, of a medicine container similar to that in FIG. 1 depicting one stackable indicator system in accordance with the invention.

FIG. 2 shows a side elevational view of another typical container which may be the same as that in FIG. 1 showing an indicator disk 16 and an additional blown apart layered disk at 16A, which may be identical to that shown at 16 and designed to removably adhere to the disk 16 such that after use, disk 16A may be peeled away leaving disk 16 to enable recording of a second record period for dosage compliance. It should be noted that the disk 16 may be mounted to the cap or lid 12 in any desired fashion or even be designed as an integral part of the cap itself.

Figure 3A:
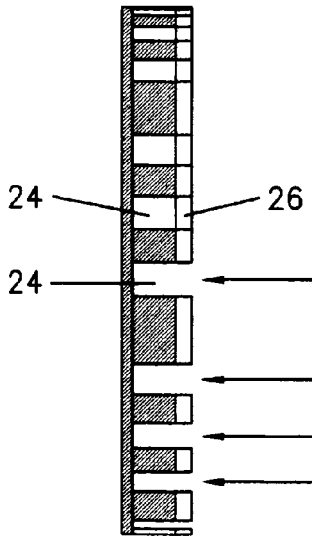
FIG. 3A depicts a side view of a disk-type indicator in accordance with the invention.
Figure 3B:
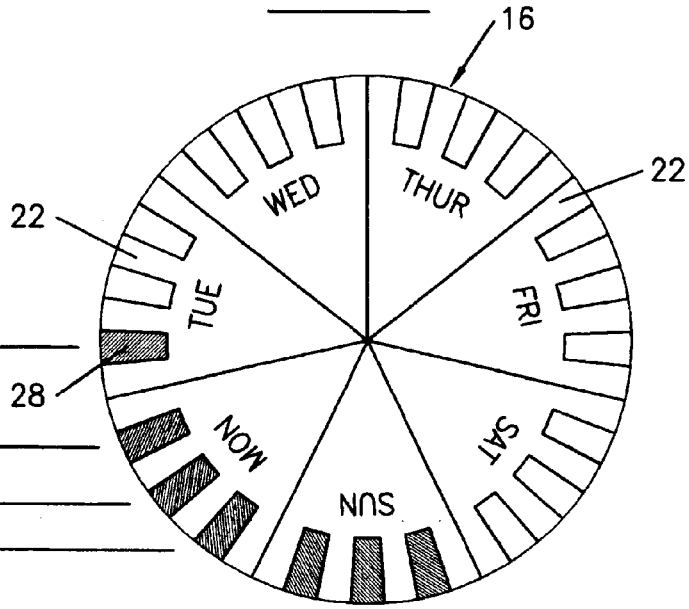
FIG. 3B is a top view of the disk shown in 3A.

FIG. 3B is a plan view of a disk indicator such as those illustrated in FIGS. 1 and 2 in which the surface of the disk is divided into a number of pie-shaped wedges representing the days of the week as at 22. Each of the wedges 22 is further divided into or contains a plurality of single dose recesses as at 24 initially covered by a readily breached overlay or layer 26. As indicated in the figures, certain of the segments of the overlay layer 26 as shown as having been breached in accordance with the taking of a dosage and thereby exposing a contrasting (lighter or darker) use indicator as at 28 as illustrated in conjunction with FIG. 3A which is the side elevational view of the disk 16.

Figure 4A:
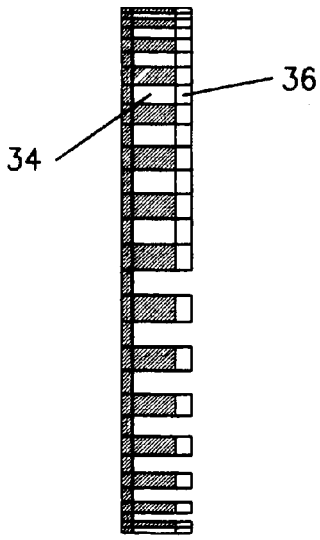
FIGS. 4A and 4B are similar to FIGS. 3A and 3B showing a variation in the dosage count system on the disk.
Figure 4B:
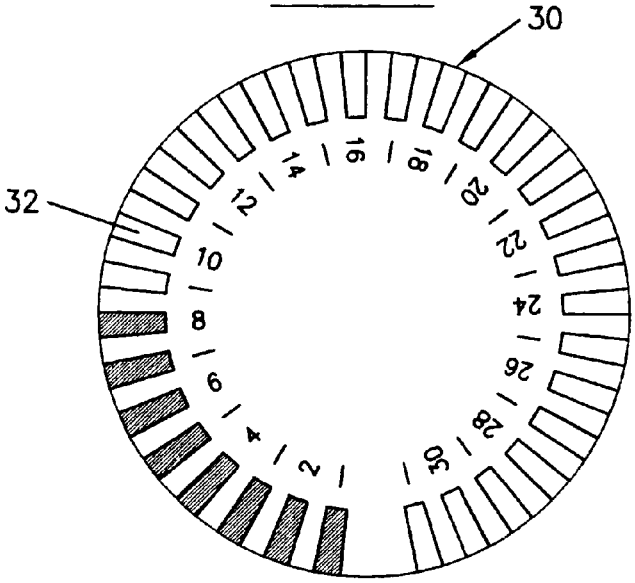

In like manner, FIGS. 4A and 4B illustrate a disk at 30 similar to that shown in FIGS. 3A and 3B utilizing a numbered scale with dosages indicated as at 32 using dates or days of the month instead of one utilizing the days of the week. Otherwise, the system is the same as that shown in FIGS. 3A and 3B and includes recesses 34 and permeable cover material as at 36. Any of these disks can be utilized in stacked form as illustrated in FIG. 2 and, it will be appreciated, that the thickness as illustrated in the figures may be somewhat exaggerated with respect to that required for actual implementation with the total thickness of such disks being possibly as thin as a paper layer.

Figure 5:
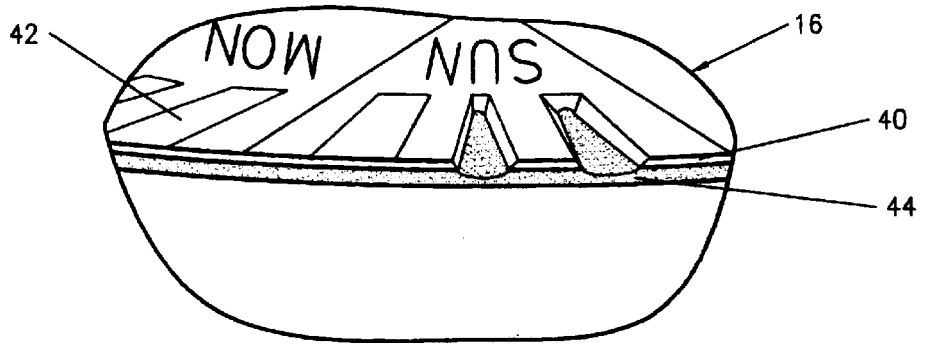
FIG. 5 is a greatly enlarged, fragmentary perspective view showing an example of a readily indented or deformed material used for the dosage indicator system in accordance with the invention.
Figure 6:
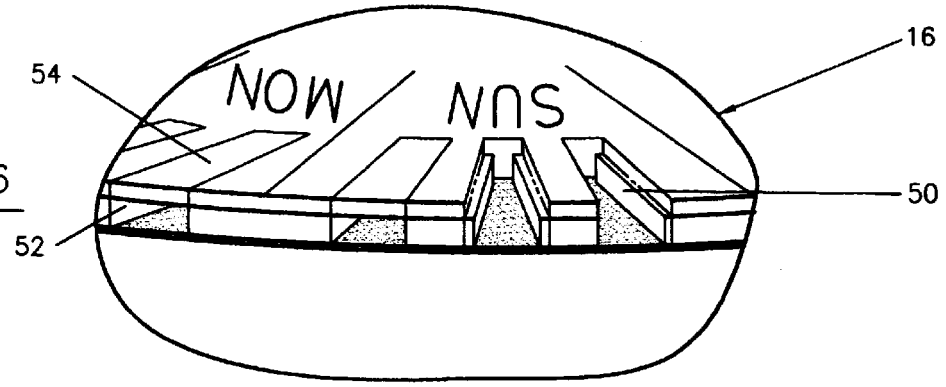
FIG. 6 is a view similar to FIG. 5 showing a knock-out and recess system.

FIGS. 5 and 6 illustrate some of many possible implementations of indentable or recessed variations which might be used with the disks as at 16 and 30. FIG. 5 illustrates a two-layer dual color or single layer dual color system dual color in which a lower layer or partial layer 40 of over color is combined with an upper layer or partial layer 42 of another color in a composite construction. The materials of the layers 40 and 42 are preferably soft enough that they are easily indented as by a fingernail or the like. This produces an indentation or groove as at 44 in the disk 16. The layer 42 need not be, but is usually the same color as the remainder of the background of the top of the disk 16 and the color exposed in the formed groove at 44 is preferably one which substantially contrasts to the color at 42 to produce a recognizable indication that the cover layer 42 has been breached. The indication may be two-fold, namely, both in that it exposes the contrasting color and that in thicker embodiments the groove that results from the breach of the overlayer may be noticed or felt.

FIG. 6 illustrates the use of more rectangular-shaped openings as at 50 with an open-ended construction as at 52 with readily rupturable knock-outs in cover layer 54. It is further contemplated in this regard that a Braille system may be used in conjunction with the notches for those whose sight is impaired. These can also be readily opened by the use of a fingernail or the like.

Figure 7:
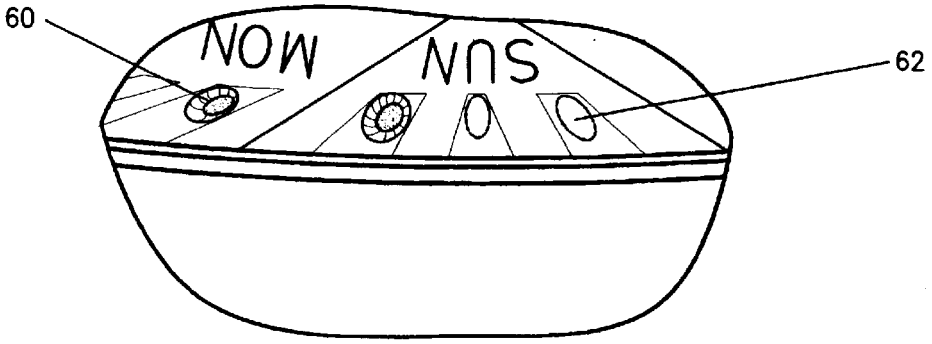
FIG. 7 is a greatly enlarged, fragmentary perspective view showing a scratch-off embodiment of the dosage indicator system of the invention.

The system illustrated in the enlarged fragmentary perspective view of FIG. 7 is intended to illustrate a similar implementation utilizing scratch-off indicators as at 60 shown after removal of a contrasting color at 62. A variety of materials are available to implement such a system which are readily scratched off either by fingernails, blunt knives, or the like. Of course, any desired color or contrast scheme can be used.

Figure 8:
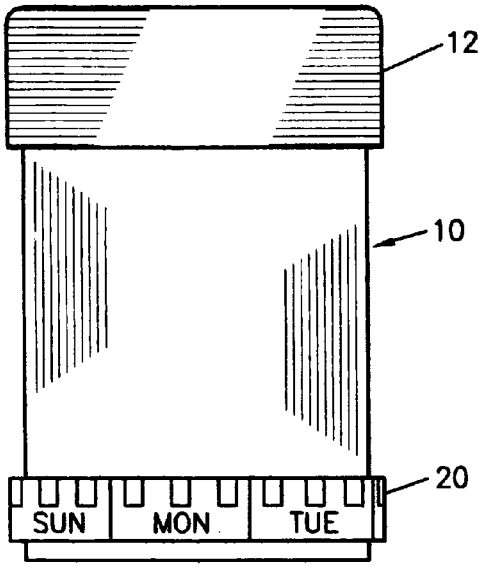
FIG. 8 depicts a medicine container similar to that shown in FIGS. 1 and 2 implemented with a bottle or vial-mounted dosage indicator system.
Figure 9:
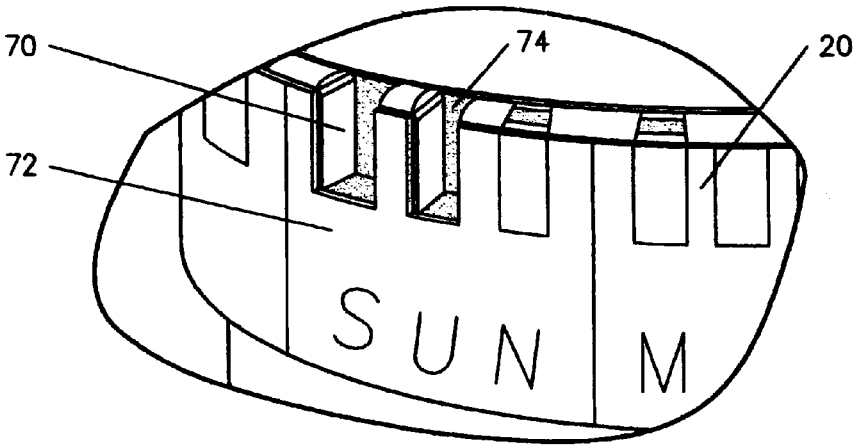
FIG. 9 is a greatly enlarged, fragmentary perspective view of one possible embodiment of the indicator system illustrated in FIG. 8.

Another alternate bottle-mounted embodiment is shown by the views of FIGS. 8 and 9 in which the vial 10 with cap 12 is shown carrying a dosage indicating band 20 about a peripheral portion independent of the cap. The enlarged fragmentary perspective view of FIG. 9 illustrates an indication system similar to that depicted in the embodiment of FIG. 6 utilizing a plurality of generally rectangular-shaped recesses 70 in conjunction with an overlayer 72, the removal of segments or knock-outs from which exposes a highly contrasting surface at 74. Of course, other approaches such as that of FIG. 5 may be used. The band 20 may be located anywhere on the vial, including the cap, and may be resiliently or adhesively applied.

Figure 10:
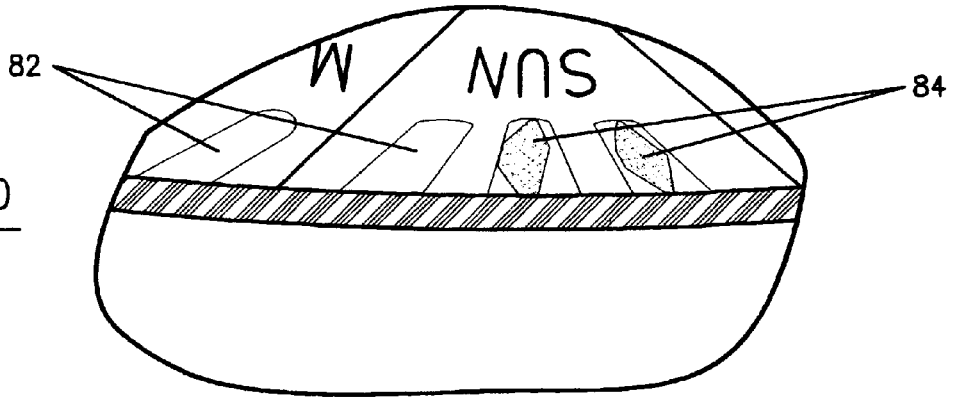
FIG. 10 is another greatly enlarged, fragmentary perspective view that illustrates a pressure sensitive color change system in which color change is produced by pressure without deformation.

FIG. 10 illustrates an alternate pressure sensitive embodiment 80 in which pressure exerted on the surface of the pressure sensitive areas as at 82 produces a contrasting surface color as at 84 to record a dosage event. In this embodiment, no physical indentation or recess is produced or is necessary to effect the color change.

Note that each of the embodiments requires a positive, irreversible act or deed by the patient or other person responsible for maintaining the dosage regimen record from the bottle or vial in order to indicate that an act of use has taken place. This may be done by punching through, as with a knock-out, or indenting the surface or pressure marking of an overlayer using a fingernail or other blunt instrument capable of fitting into the groove, scratching or rubbing off overlayer material, or the like. Once the overlayer or surface has been breached or indented or marked, there is no way this act can be inadvertently reversed as in the case of moveable dials or other such indicating devices. The use of contrasting colors, optionally with physical indentation permits identification of use by visual and optionally by both physical recognition of a permanent indentation and visual recognition of color contrast.

This invention has been described herein in considerable detail in order to comply with the Patent Statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A record keeping system for creating a compliance record for self-medication of pharmaceutical products for consumption in a plurality of doses, said system comprising:

(a) a container for storing a pharmaceutical product of interest;

(b) a container cap associated with said container;

(c) an indicia system on said container cap, comprising a lower soft layer of a first color and a disk of substantially rigid material overlaying said lower layer, said disk having a plurality of apertures wherein each of said apertures contains an upper soft layer of a second color distinct from said first color, each of said upper layers overlaying and engaging said lower layer wherein each upper layer is of a material allowing it to be indented to reveal the lower layer.

2. The record keeping system of claim 1 wherein said container cap further comprises an additional indicia system to extend the time of the compliance record.

3. The record keeping system of claim 1 wherein said series of plurality of apertures are arranged radially about the container cap.

4. The record keeping system of claim 3 wherein said plurality of apertures are substantially rectangular.

* * * * *

UNITED STATES PATENT AND TRADEMARK OFFICE

CERTIFICATE OF CORRECTION

PATENT NO. : 6,032,609

DATED : March 7, 2000

INVENTOR(S) : Van A. Luoma

It is certified that error appears in the above-indentified patent and that said Letters Patent is hereby corrected as shown below:

In Column 6, claim 3, line 59, delete "series of".

Signed and Sealed this

Twenty-sixth Day of December, 2000

*Attest:*

Q. TODD DICKINSON

*Attesting Officer*

*Director of Patents and Trademarks*